United States Patent [19]

Adair et al.

[11] Patent Number: 4,994,341

[45] Date of Patent: Feb. 19, 1991

[54] ORGANOMETALLIC COMPOUNDS AS MOTTLE PREVENTION ADDITIVES IN LIQUID ELECTROSTATIC DEVELOPERS

[75] Inventors: Paul C. Adair, Downingtown; Lalit M. Bhalla, West Chester; Ronald L. Mueller, Exton, all of Pa.

[73] Assignee: DXImaging, Lionville, Pa.

[21] Appl. No.: 453,835

[22] Filed: Dec. 20, 1989

[51] Int. Cl.[5] ..... G03G 9/12

[52] U.S. Cl. ..... 430/115; 430/904; 430/110

[58] Field of Search ..... 430/115, 110, 904

[56] References Cited

U.S. PATENT DOCUMENTS 4,663,264 6/1987 Mitchell ..... 430/115
4,707,429 11/1987 Trout ..... 430/115

FOREIGN PATENT DOCUMENTS 51-107833 9/1976 Japan .
53-57039 5/1978 Japan .
60-13171 4/1985 Japan .

*Primary Examiner*—David Welsh

[57] ABSTRACT

Electrostatic liquid developer consisting essentially of (A) nonpolar liquid, Kauri-butanol value less than 30, (B) particles of thermoplastic resin having free carboxyl groups (<30μm ave particle size), (C) nonpolar liquid soluble oil-soluble petroleum sulfonate or anionic glyceride charge director, and (D) at least one organometallic compound as defined present in 0.01 to 0.15 part by weight metal based on the total weight of liquid developer. The process of preparation of the liquid developer is also disclosed. The developers demonstrate reduced mottle in a fused image. The developers are used in copying, color proofing, preparation of lithographic printing plates and resists.

47 Claims, No Drawings

ORGANOMETALLIC COMPOUNDS AS MOTTLE PREVENTION ADDITIVES IN LIQUID ELECTROSTATIC DEVELOPERS

TECHNICAL FIELD

This invention relates to an electrostatic liquid developer having improved properties. More particularly this invention relates to an electrostatic liquid developer containing particles of a thermoplastic resin having free carboxyl groups and at least one organometallic compound as a mottle prevention additive.

BACKGROUND OF THE INVENTION

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid developers are comprised of thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 30 μm average size as measured using a Malvern 3600E Particle Sizer described below. After the latent electrostatic image has been formed, the image is developed by the colored toner particles dispersed in said dispersant nonpolar liquid and the image may subsequently be transferred to a carrier sheet and fused to the carrier sheet.

Since the formation of proper images depends on the differences of the charge between the liquid developer and the latent electrostatic image to be developed, it has been found desirable to add a charge director compound and preferably adjuvants, e.g., polyhydroxy compounds, aminoalcohols, polybutylene succinimide, an aromatic hydrocarbon, metallic soaps, etc., to the liquid developer comprising a thermoplastic resin having free carboxyl groups, dispersant nonpolar liquid, and preferably a colorant. Such liquid developers provide images of good resolution and charging but it has been found that image quality is deficient. The toned and transferred images have a speckled or mottled appearance after the fusing step. In order to overcome this problem much research effort has been expended to develop new types of mottle prevention additives for electrostatic liquid toners.

It has been found that the above disadvantages can be overcome and improved developers prepared containing a dispersant nonpolar liquid, charge director compound, a thermoplastic resin having free carboxyl groups, optionally a colorant, and a mottle prevention additive of the invention. The improved electrostatic liquid developer when used to develop an electrostatic image results in improved image quality, transfer efficiency and improved solid area coverage independent of the pigment and charge director present.

SUMMARY OF THE INVENTION

In accordance with this invention there is provided an electrostatic liquid developer consisting essentially of (A) a nonpolar liquid having a Kauri butanol value of less than 30, present in a major amount, (B) particles having an average particle size of less than 30 μm of a thermoplastic resin having free carboxyl groups, (C) a nonpolar liquid soluble charge director compound selected from the group consisting of oil-soluble petroleum sulfonate and anionic glycerides, and (D) at least one organometallic compound, selected from the group consisting of:

$$M^{+n}(R^-)_n,$$

$$M^{+n}(CO_2R'^-)_n$$

and $$M^{+n}(OR''^-)_n$$

where R, R′ and R″, which can be the same or different, are moieties of a linear hydrocarbon of 1 to 30 carbon atoms, a branched chain hydrocarbon of 1 to 30 carbon atoms, or a linear or branched chain, substituted hydrocarbon of 1 to 30 carbon atoms, M is a metal, and n is at least 2 and is equal to the valency of the metal.

In accordance with an embodiment of this invention there is provided a process for preparing an electrostatic liquid developer for electrostatic imaging comprising (A) dispersing at an elevated temperature in a vessel a thermoplastic resin having free carboxyl groups, a dispersant nonpolar liquid having a Kauri-butanol value of less than 30, and optionally a colorant, while maintaining the temperature in the vessel at a temperature sufficient to plasticize and liquify the resin and below that at which the dispersant nonpolar liquid degrades and the resin and/or colorant decomposes, (B) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(C) separating the dispersion of toner particles having an average particle size of less than 30 μm from the particulate media, (D) adding to the dispersion a nonpolar liquid soluble charge director compound selected from the group consisting of oil-soluble petroleum sulfonate and anionic glycerides, and (E) adding subsequent to step (C) at least one organometallic compound, selected from the group consisting of formula:

$$M^{+n}(R^-)_n,$$

$$M^{+n}(CO_2R'^-)_n$$

and $M^{+n}(OR''^{-})_n$ where R, R' and R'', which can be the same or different, are moieties of a linear hydrocarbon of 1 to 30 carbon atoms, a branched chain hydrocarbon of 1 to 30 carbon atoms, or a linear or branched chain, substituted hydrocarbon of 1 to 30 carbon atoms, M is a metal, and n is at least 2 and is equal to the valency of the metal.

Throughout the specification the below-listed terms have the following meanings:

In the claims appended hereto "consisting essentially of" means the composition of the electrostatic liquid developer does not exclude unspecified components which do not prevent the advantages of the developer from being realized. For example, in addition to the primary components, there can be present additional components, such as inorganic fine particle oxides, adjuvant, e.g., polyhydroxy compound, aminoalcohol, polybutylene succinimide, aromatic hydrocarbon, metallic soap, etc.

Aminoalcohol means that there is both an amino functionality and hydroxyl functionality in one compound.

Mobility is measured as described in the examples and is expressed in $m^2/Vsec(\times 10^{-10})$ wherein V is volts.

Viscosity is measured as described in the examples below and is expressed in centipoise (cp).

Conductivity is the conductivity of the developer measured in picomhos (pmho)/cm at 5 hertz and 5 volts.

Mottle is defined as a visible inhomogeneity in image reflection density, appearing as crater-like defects. This mottle is manifested during the fusing step and is aggravated by higher fusing temperatures and by high wetting of the paper by the hydrocarbon carrier, e.g., nonpolar liquid. The image defect is believed to be brought about by the escape of hydrocarbon vapor through a partially fused toner layer.

The dispersant nonpolar liquids (A) of the liquid developer are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an autoignition temperature of 338° C. Stringent manufacturing specifications, limit the contents of sulphur, acids, carboxyl, and chlorides to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| | Flash Point (°C.) | Auto-Ignition Temp (°C.) |
|---|---|---|
| Norpar ®12 | 69 | 204 |
| Norpar ®13 | 93 | 210 |
| Norpar ®15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 10.0% by weight. The total weight of solids in the liquid developer is solely based on the resin, including components dispersed therein, e.g., pigment component, adjuvant, etc.

Useful thermoplastic resins or polymers (B) having free carboxyl groups include: copolymers of ethylene and an $\alpha,\beta$-ethylenically unsaturated acid selected from the group consisting of acrylic acid and methacrylic acid, copolymers of ethylene (80 to 99.9%)/acrylic or methacrylic acid (20 to 0.1%)/alkyl (C1 to C5) ester of methacrylic or acrylic acid (0 to 20%), Surlyn® ionomer resin by E. I. du Pont de Nemours and Company, Wilmington, Del., etc. or blends thereof. Preferred copolymers are the copolymer of ethylene and an unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 60 and a melt index of 100 and 500 determined at 190° C., respectively.

Resins that do not have free carboxyl groups may be used in combination with the above resins in amounts up to 95% by weight based on the total weight of resins. Such resins include: ethylene vinyl acetate (EVA) copolymers (Elvax® resins, E. I. du Pont de Nemours and Company, Wilmington, Del.), polyethylene, polystyrene, isotactic polypropylene (crystalline), ethylene ethyl acrylate series sold under the trademark Bakelite® DPD 6169, DPDA 6182 Natural and DTDA 9169 Natural by Union Carbide Corp., Stamford, Conn; ethylene vinyl acetate resins, e.g., DQDA 6479 Natural and DQDA 6832 Natural 7 also sold by Union Carbide Corp.

In addition, the thermoplastic resins have the following preferred characteristics:

1. Be able to disperse the adjuvant, colorant, e.g., pigment,
2. Be substantially insoluble in the dispersant liquid at temperatures below 40° C., so that the resin will not dissolve or solvate in storage,
3. Be able to solvate at temperatures above 50° C.,
4. Be able to be ground to form particles between 0.1 μm and 15 μm, in diameter,
5. Be able to form a particle of less than 30 μm, e.g., determined by Malvern 3600E Particle Sizer, manufactured by Malvern, Southborough, Mass. The Malvern 3600E Particle Sizer uses laser diffraction light scattering of stirred samples to determine average particle sizes.
6. Be able to fuse at temperatures in excess of 60° C.

By solvation in 3. above, the resins forming the toner particles will become swollen or gelatinous.

Suitable nonpolar liquid soluble charge director compounds (C), which are generally used in an amount of 0.25 to 1500 mg/g, preferably 2.5 to 400 mg/g developer solids, include: negative charge directors, e.g., Basic Calcium Petronate®, Basic Barium Petronate®, oil-soluble petroleum sulfonates, manufactured by Sonneborn Division of Witco Chemical Corp., New York, N.Y.; positive charge directors, e.g., anionic glycerides such as Emphos® D70-30C, Emphos® F27-85, etc., salts, e.g., sodium, etc., of phosphated mono- and diglycerides with unsaturated and saturated acid substituents manufactured by Witco Chemical Corp., New York, N.Y., etc. The glyceride charge directors are disclosed in El-Sayed et al. U.S. Ser. No. 07/125,503, filed Nov. 25, 1987, the disclosure of which is incorporated herein by reference.

The organometallic mottle prevention additive (D) is selected from the group consisting of:

$$M^{+n}(R^-)_n,$$

$$M^{+n}(CO_2R'^-)_n$$

and $$M^{+n}(OR''^-)_n$$

where R, R' and R'', which can be the same or different, are moieties of a linear hydrocarbon of 1 to 30 carbon atoms, a branched chain hydrocarbon of 1 to 30 carbon atoms, or a linear or branched chain hydrocarbon of 1 to 30 carbon atoms substituted with halogen, e.g., Cl, Br, I, F; one or more hydroxyl groups, nitro, cyclopentyl, cyclohexyl, aryl, e.g., phenyl, naphthyl, etc.; substituted aryl, e.g., substituted phenyl, naphthyl, etc.;

M is Bi, Ca, Ce, Co, Fe, Mg, Mn, Mo, Ni, Pb, Ti, V, Zn, Zr, etc.;

n is at least 2 and is equal to the valence of the metal (M).

One or more of the organometallic carboxylate or alkoxide type compounds can be present in the electrostatic liquid developer. Many of the organometallic compounds are available commercially, e.g., as a solution in mineral spirits (a hydrocarbon mixture of boiling point 130°-145° C., a.k.a., ligroin).

The organometallic compound may be added to the developer prior to, concurrently with, or after the addition of the charge director. However, the addition of the organometallic compound to the developer cannot take place during the hot dispersion or cold grinding steps because that would considerably lengthen grinding times. In addition to eliminating mottle, the addition of these organometallic compounds later in the process allows for the use of lower molecular weight resins which are more easily ground. The resin in the toner particles can then be converted to the required higher molecular weight by the addition of these organometallic compounds. The organometallic compound is present in 0.01 to 0.15 part by weight metal based on the total weight of liquid developer.

Examples of organometallic compounds, wherein the substituents (ligands) attached to $M^{+n}$ in the formula for the organometallic compound are selected from the group consisting of propionate, butyrate, hexoate, octaoate, nonoate, 2-ethylhexoate, neodecanoate, naphthenate, ethoxide, butyl, isopropyl, etc., include: zinc naphthenate, zinc 2-ethylhexoate, zinc octoate, zirconium octoate, zirconium 2-ethylhexoate, manganese octoate, manganese naphthenate, manganese 2-ethylhexoate, barium 2-ethylhexoate, cobalt naphthenate, calcium octoate, calcium naphthenate, calcium 2-ethylhexoate, calcium nonoate, nickel octoate, bismuth octoate, bismuth neodecanoate, bismuth 2-ethylhexoate, lead octoate, cobalt octoate, lead naphthenate, cerium naphthenate, cerium 2-ethylhexoate, tetrabutyl titanate, tetra-2-ethylhexyl titanate, titanium tetraethoxide, tetraisopropyl titanate; calcium, cerium, cobalt, lead, manganese, zinc and zirconium salts of neodecanoic acid made by Mooney, Inc., Cleveland, Ohio, and mixtures of the compounds.

Colorants, such as pigments or dyes and combinations thereof, are preferably present dispersed in the resin particles to render the image visible. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of useful pigments include:

PIGMENT LIST

| Pigment Brand Name | Manufacturer | Pigment Colour Index |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar® Yellow YT-858-D | Heubach | Yellow 74 |
| Hansa Yellow X | Hoechst | Yellow 75 |
| Novoperm® Yellow HR | Hoechst | Yellow 83 |
| Chromophtal® Yellow 3G | Ciba-Geigy | Yellow 93 |
| Chromophtal® Yellow GR | Ciba-Geigy | Yellow 95 |
| Novoperm® Yellow FGL | Hoechst | Yellow 97 |
| Hansa Brilliant Yellow 10GX | Hoechst | Yellow 98 |
| Lumogen® Light Yellow | BASF | Yellow |
| Sicofast®-185 | BASF | Yellow |
| 110 Permanent Yellow G3R-01 | Hoechst | Yellow |
| 114 Chromophtal® Yellow 8G | Ciba-Geigy | Yellow |
| 128 Irgazin® Yellow 5GT | Ciba-Geigy | Yellow |
| 129 Hostaperm® Yellow H4G | Hoechst | Yellow |

-continued

PIGMENT LIST

| Pigment Brand Name | Manufacturer | Pigment Colour Index |
|---|---|---|
| 151 Hostaperm ® Yellow H3G | Hoechst | Yellow |
| 154 L74-1357 Yellow | Sun Chem. | |
| L75-1331 Yellow | Sun Chem. | |
| L75-2377 Yellow | Sun Chem. | |
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | |
| Heliogen ® Blue K 7090 | BASF | Blue 15:3 |
| Heliogen ® Blue L 7101F | BASF | Blue 15:4 |
| Heliogen ® Blue D 7072 DD | BASF | Blue 15:3 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | |
| Mogul L | Cabot | |
| BK 8200 Black Toner | Paul Uhlich | |
| Monarch ®1000 | Cabot | |

Other ingredients may be added to the electrostatic liquid developer, such as fine particle size inorganic oxides, e.g., silica, alumina, titania, etc.; preferably in the order of 0.5 μm or less can be dispersed into the liquefied resin. These oxides can be used instead of the colorant or in combination with the colorant. Metal particles can also be added.

Another additional component of the electrostatic liquid developer is an adjuvant which can be selected from the group consisting of polyhydroxy compound which contain at least 2 hydroxy groups, aminoalcohol, polybutylene succinimide, metallic soap, and aromatic hydrocarbons having a Kauri-butanol value of greater than 30. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxystearate, etc. as described in Mitchell U.S. Pat. No. 4,734,352.

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc. as described in Larson U.S. Pat. No. 4,702,985.

polybutylene/succinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984.

metallic soap: aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium cobalt, manganese, lead and zinc naphthenates; calcium, cobalt, manganese, lead and zinc resinates; etc. The metallic soap is dispersed in the thermoplastic resin as described in Trout U.S. Pat. Nos. 4,707,429 and 4,740,444.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of C9 and C10 alkyl-substituted benzenes manufactured by Exxon Corp., etc. as described in Mitchell U.S. Pat. No. 4,631,244.

The particles in the electrostatic liquid developer have an average by area particle size of less than 30 μm as measured by Malvern 3600E Particle Sizer, preferably the average particle size is less than 15 μm. In the appended claims the average particle size is as measured by the Malvern instrument. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or a two roll heated mill (no particulate media necessary) are placed at least one of thermoplastic resin, and dispersant nonpolar liquid described above. Generally the resin, colorant, charging adjuvant and dispersant nonpolar liquid are placed in the vessel prior to starting the dispersing step. Optionally the colorant can be added after homogenizing the resin and the dispersant nonpolar liquid. Polar additive, e.g., those described in Mitchell U.S. Pat. No. 4,631,244, the disclosure of which is incorporated herein by reference, can also be present in the vessel, e.g., up to 100% based on the weight of nonpolar additive. The dispersing step is generally accomplished at elevated temperature, i.e., the temperature of ingredients in the vessel being sufficient to plasticize and liquefy the resin but being below that at which the dispersant nonpolar liquid or polar additive, if present, degrades and the resin and/or colorant decomposes. A preferred temperature range is 80° to 120° C. Other temperatures outside this range may be suitable, however, depending on the particular ingredients used. The presence of the moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. selected from the group consisting of stainless steel, carbon steel, alumina, ceramic, zirconia, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar additive present until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding with or without the presence of additional liquid with particulate media to prevent the formation of a gel or solid mass; without stirring to form a gel or solid mass, followed by shredding the gel or solid mass and grinding, e.g., by means of particulate media with or without the presence of additional liquid; or with stirring to form a viscous mixture and grinding by means of particulate media with or without the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size of less than 30 μm, as determined by a Malvern 3600E Particle Sizer described above or other comparable apparatus, are formed by grinding for a relatively short period of time.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. At least one organometallic salt is added after particulate media are separated from the dispersion of toner particles and preferably are added to the diluted toner. The concentration of the toner particles in the dispersion is reduced by the addition of additional nonpolar liquid as described previously above. The dilution is normally conducted to reduce the concentration of toner particles to between 0.1 to 15 percent by weight, preferably 0.3 to 4.0, and more preferably 1.0 to 3.0 weight percent with respect to the nonpolar liquid. One or more nonpolar liquid soluble charge director compounds (C), of the type set out above, can be added to impart a positive or negative charge, as desired. The addition may occur at any time during the process; preferably at the end of the process, e.g., after the particulate media, if used, are removed and the concentration of toner particles is accomplished. If a diluting nonpolar liquid is also added, the charge director compound can be added prior to, concurrently with, or subsequent thereto. If an adjuvant compound or organometallic compound has not been previously added in the preparation of the developer, they can be added prior to, concurrently with, or subsequent to the developer being charged. Preferably the mottle prevention additive is added along with the charge director compound. It has been found that the mottle prevention agent has little or no effect on the viscosity of the liquid developed. The viscosity of the liquid electrostatic developers of this invention range from about 1 to 10 cp, preferably 1 to 5 cp, measured in the concentration range of 1 to 3 weight percent.

Other process embodiments for preparing the electrostatic liquid developer include:

(A) dispersing a colorant in a thermoplastic resin in the absence of a dispersant nonpolar liquid having a Kauri-butanol value of less than 30 to form a solid mass.

(B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average particle size of less than 30 μm from the particulate media, and (E) adding additional nonpolar liquid, polar liquid or combinations thereof to reduce the concentration of toner particles to between 0.1 to 15.0 percent by weight with respect to the liquid, (F) adding to the dispersion a liquid soluble charge director compound selected from the group consisting of oil-soluble petroleum sulfonate and anionic glycerides, and (G) adding subsequent to step (D) 0.01 to 0.15 part by weight metal based on the total weight of liquid developer at least one organometallic compound as defined above; and (A) dispersing a colorant in a thermoplastic resin in the absence of a dispersant nonpolar liquid having a Kauri-butanol value of less than 30 to form a solid mass.

(B) shredding the solid mass, (C) redispersing the shredded solid mass at an elevated temperature in a vessel in the presence of a dispersant nonpolar liquid having a Kauri-butanol value of less than 30, and optionally a colorant, while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average particle size of less than 30 μm from the particulate media, and (F) adding additional nonpolar liquid, polar liquid or combinations thereof to reduce the concentration of toner particles to between 0.1 to 15.0 percent by weight with respect to the liquid; and (G) adding to the dispersion a liquid soluble charge director compound, and (H) adding subsequent to step (E) 0.01 to 0.15 part by weight metal based on the total weight of liquid developer at least one organometallic compound as defined above.

INDUSTRIAL APPLICABILITY

The electrostatic liquid developers of this invention demonstrate reduced mottle, improved image quality, resolution, solid area coverage, and toning of fine details, evenness of toning, and reduced squash. These developers invention are useful in copying, e.g., making office copies of black and white as well as various colors; in color proofing, e.g., a reproduction of an image using the substractive primary colors: yellow, cyan, magenta together with black as desired. In copying and proofing the toner particles are applied to a latent electrostatic image. Other uses which are envisioned for the electrostatic liquid developers include: digital color proofing, lithographic printing plates, and resists.

EXAMPLES

The following controls and examples, wherein the parts and percentages are by weight, illustrate but do not limit the invention. In the examples the melt indices were determined by ASTM D 1238, Procedure A, the average particle sizes were determined by a Malvern 3600E Particle Sizer, manufactured by Malvern, Southborough, MA as described above, the conductivity was measured in picomhos (pmho)/cm at 5 Hertz and low voltage, 5 volts, and the density was measured using a Macbeth densitometer model RD918. The resolution is expressed in the Examples in μm.

The following procedure was used to measure the mottle image defect in Examples 1, 2, 3 and 6: an Isopar ®-L wetted sheet of 80-pound Centura ® gloss paper, manufactured by Consolidated Papers, Chicago, IL was placed between two metal plates which were separated by a 0.03 cm gap. One plate was connected to ground and the other was charged to 150 V. The plates were set at an angle of 45° and charged developer was cascaded down the paper. The resultant toned sheet was heated on a constant temperature hot plate at 115° C. for 1 minute to remove any residual Isopar ® and to fuse the toner particles. The fused image was then examined for the mottle defect, 1 representing no visible mottle, 2 some mottle, and 3 severe mottle equal to control.

CONTROL 1

The following ingredients were placed in a Union Process 1S Attritor, Union Process Company, Akron, Ohio:

| Ingredient | Amount (g) |
|---|---|
| Copolymer of ethylene (90%) and methacrylic acid (10%) melt index at 190° C. is 500, acid no. is 60 | 240 |
| Mogul ® L carbon black, C.I. 77266, Cabot Corporation, Carbon Black Division, Boston, MA | 60 |
| Isopar ®-L, nonpolar liquid having a Kauri-butanol value of 27, Exxon Corporation | 1200 |

The ingredients were heated to 105° C. and milled with 0.1875 inch (4.76 mm) diameter carbon steel balls for 1 hour. The attritor was cooled to a temperature of 26° C. while the milling was continued. Milling was continued for 6 hours to obtain toner particles with an average size of 7.5 μm. The particulate media were removed and the dispersion of toner particles was then diluted to 3 percent solids with additional Isopar ®-L. To the dispersion was added 10% Basic Barium Petronate ® (Witco Chemical Corp., New York, NY) (70 mg/g of developer solids) in Isopar ®-L. The mottle image defect test outlined above was conducted and a mottled pattern was noted for this developer.

EXAMPLE 1

Control 1 was repeated with the following exception: mottle prevention additives (MPA) outlined in Table 1 were added to the diluted, charged developer (1% MPA/developer solids). The mixtures were allowed to equilibrate for three days prior to testing. The mottle image defect test outlined above was run with the results outlined in Table 1 below. The mobilities were determined by an electrokinetic sonic analysis instrument, Matec, Inc., Hopkinton, MA. From the instrument measurement mobility is calculated in $m^2/Vsec(\times 10^{-10})$.

| | MOTTLE PREVENTION | |
|---|---|---|
| ADDITIVE | DEGREE OF MOTTLE | MOBILITY |
| Zinc naphthenate | 1 | −14.1 |
| Zirconium octoate | 1 | −17.8 |
| Zinc 2-ethylhexoate | 1 | −15.1 |
| Manganese octoate | 1 | −12.4 |
| Zinc octoate | 1 | −15.0 |
| Cobalt naphthenate | 1 | −15.2 |
| Calcium octoate | 1 | −16.8 |
| Calcium naphthenate | 1 | −15.1 |
| Zirconium 2-ethylhexoate | 1 | −18.4 |
| Calcium 2-ethylhexoate | 1 | −13.9 |
| Manganese 2-ethylhexoate | 1 | −13.6 |
| Tetra-2-ethylhexyl titanate | 1 | −15.8 |
| Titanium tetraethoxide | 1 | −17.6 |
| None (Control 1) | 3 | −13.3 |

The results show that the additives alleviated mottle and, in most cases, increased mobility.

EXAMPLE 2

A toner of the following formulation was produced and charged, as described in Example 1:

| INGREDIENT | AMOUNT (g) |
|---|---|
| Copolymer of ethylene/ methacrylic acid as described in Ex. 1 | 237 |
| Monarch 1000 Carbon black (Cabot Corp., Boston, MA) | 60 |
| Witco 22 (aluminum stearate, Witco Corp, New York, NY) | 3 |
| Isopar ®-L, Exxon Corp. | 1200 |

Mottle prevention additives, outlined in Table 2, were added to the developer at a 1% level and the mixtures were equilibrated for 24 hours. Results are shown in Table 2 below.

TABLE 2

| | MOTTLE PREVENTION | |
|---|---|---|
| ADDITIVE | DEGREE OF MOTTLE | MOBILITY |
| Calcium octoate | 1 | −19.8 |
| Tetrabutyl titanate | 1 | −21.8 |
| None (Control) | 3 | −16.6 |

EXAMPLE 3

Example 2 was repeated with the following exceptions: 252 g of the copolymer and 45 g of Monarch ®

1000 were used instead of 237 g and 60 g, respectively. The mottle prevention additives shown in Table 3 below were added to the diluted developer at levels of 0.25%, 0.5%, 0.75% and 1.0% (w/w solids). The so prepared developers were allowed to set for 18 hours and then were tested as described earlier for their propensity to mottle.

TABLE 3

| MOTTLE PREVENTION | | | | |
|---|---|---|---|---|
| ADDITIVE | MOTTLE RATING | | | |
| Zinc octoate | 3 | 2 | 2 | 1 |
| Zinc 2-ethylhexoate | 3 | 2 | 2 | 1 |
| Zirconium 2-ethylhexoate | 3 | 2 | 1 | 1 |
| Zirconium octoate | 2 | 1 | 1 | 1 |
| None (Control) | 3 | — | — | — |
| AMOUNT (W/W SOLIDS) | 0.25% | 0.5% | 0.75% | 1.0% |

EXAMPLE 4

7 samples of liquid developer were prepared as described in Example 3 and then diluted to 3% solids. To each of samples 1, 2, 3, and 4 were added 70 mg Basic Barium Petronate® (BBP)/g of developer solids. To samples 2, 3, and 4 were also added at 1% (w/w solids) mottle prevention additives set out in Table 4 below. To samples 5, 6 and 7 were only added 1% of a mottle prevention additive. Results are outlined in the Table 4.

TABLE 4

| SAMPLE | ADDITIVE | MOBILITY | CONDUCTIVITY (pmho/cm) |
|---|---|---|---|
| 1 | BBP | −13.1 | 34 |
| 2 | BBP + Calcium octoate | −15.7 | 32 |
| 3 | BBP + Zinc octoate | −16.7 | 33 |
| 4 | BBP + Maganese octoate | −14.8 | 26 |
| 5 | Calcium octoate | −0.9 | <1 |
| 6 | Zinc octoate | −2.2 | <1 |
| 7 | Manganese octoate | −1.2 | <1 |

The mottle prevention additives did not function as charge directors when used alone, but consistently increased the mobility of negatively charged developers when used in combination with Basic Barium Petronate®.

EXAMPLE 5

A black toner was prepared as described in Example 2, was diluted to 3% solids and then charged with 70 mg Basic Barium Petronate®/g of developer solids. The diluted and charged developer was allowed to sit for 72 hours. The developer was divided into 2-liter portions, and to each was added one of the mottle prevention additives outlined in Table 5 below. The developer was allowed to sit 4 hours prior to use. Image quality, using this developer, was determined using a selenium photoconductive drum which is imagewise exposed by a laser, toned with the developer and the developer image transferred to onto Centura® Gloss Paper, manufactured by Consolidated Papers, Inc., Chicago, IL, which paper has been prewet with Isopar®-L. The transferred image was then heated to 140° C. to evaporate the Isopar® and fuse the toner particles in the developer. Data was obtained on image mottle, gloss and density. The degree of mottle was obtained with both the unaided eye and under 210X magnification.

TABLE 5

| ADDITIVE | DENSITY | GLOSS | DEGREE OF MOTTLE |
|---|---|---|---|
| None (Control) | 1.59 | 84 | Very high mottle |
| 0.5% Zr Octoate | 1.60 | 68 | No visible mottle Some microscopic mottle |
| 0.5% Zr 2-ethylhexoate | 1.55 | 61 | No visible mottle No microscopic mottle |
| 1% Zn Octoate | 1.61 | 75 | No visible mottle High microscopic mottle |
| 1% Mn Octoate | 1.54 | 74 | No visible mottle Some microscopic mottle |

EXAMPLE 6

The following ingredients were placed in a Union Process 1S Attritor, Union Process Company, Akron, Ohio:

| Ingredient | Amount (g) |
|---|---|
| Copolymer of ethylene and methacrylic acid as described in Ex. 1 | 342.4 |
| Sterling® NS carbon black, Cabot Corporation, Carbon Black Division, Boston, MA | 79.7 |
| NBD 7010, BASF Corporation, cyan pigment | 1.6 |
| Aluminum stearate, Witco Chemical Corp., New York, NY | 4.3 |
| Isopar®-L, nonpolar liquid having a Kauri-butanol value of 27, Exxon Corporation | 1200 |

The ingredients were heated to 105° C. and milled with 0.1875 inch (4.76 mm) diameter carbon steel balls for 1 hour. The attritor was cooled to a temperature of 26° C. while the milling was continued. Milling was continued for 3 hours to obtain toner particles with an average size of 7.5 μm. The particulate media were removed and the dispersion of toner particles was then diluted to 1.5 percent solids with additional Isopar®-L. To the dispersion was added 10% Basic Barium Petronate®, (Witco Chemical Corp., New York, NY) (10 mg/g of developer solids) in Isopar®-L.

Image quality was determined as follows: a layer of a photopolymerizable composition containing of 57.0% poly(styrenemethylmethacrylate), 28.6% ethoxylated trimethylolpropane triacrylate, 10.6% 2,2',4,4'-tetrakis-(o-chlorophenyl)-5,5'-bis(m,p-dimethoxyphenyl)-biimidazole, and 3.8% 2-mercaptobenzoxazole was coated on an aluminized polyethylene terephthalate film substrate. A 0.00075 inch (0.0019 cm) thick polypropylene cover sheet was laminated to the dried photopolymerizable layer which was imagewise exposed in a Douthitt Option X unit manufactured by Douthitt Corp., Detroit, MI, equipped with a Model TU64 Violux® 5002 lamp assembly manufactured by Exposure Systems Corporation, Bridgeport, CT and a photopolymer type 5027 lamp, through a half-tone negative film with its emulsion side in contact with the polypropylene cover sheet. The polypropylene cover sheet was removed, and the exposed laminate was charged positively by passing over a +4.5 kV corotron at approximately 0.5 inch/second (approximately 1.77 cm/second). This afforded +270 V on exposed regions of the film, and less than +15 volts in unexposed regions, measured 15 seconds after charging. The film was the toned with the charged liquid electrostatic developer, using a 0.04 inch (approximately 1.0 mm) toner-filled gap between a flat development electrode and the charged film.

The toned image was electrostatically transferred to paper using a bias roll. Plainwell Solitaire offset enamel paper was wrapped around a metal drum to which a voltage of +200 V was applied. The toned photopolymerizable film was spaced 0.006 inch (0.15 mm) from the paper, the gap being filled with Isopar ®-H. Transfer was carried out at 0.17 ips (0.43 cm/second). The paper was removed from the bias roll and was heated at 110° C. for 1 minute to fuse the toned image and fix it to the paper. The results are shown in Table 6.

TABLE 6

| ADDITIVE | DOT RANGE | RESOLUTION (μ) | MOTTLE |
|---|---|---|---|
| None | 92 | 40 | 3 |
| 1% Zn Octoate | 91 | 50 | 2 |
| 0.5% Ca 2-ethyl-hexoate | 93 | 40 | 1 |
| 1% Ca Octoate | 89 | 45 | 1 |
| 0.5% Zr Octoate | 85 | 55 | 1 |
| 1% Mn Octoate | 93 | 40 | 1 |

EXAMPLE 7

A developer was prepared as described in Example 1 with the following exceptions: the following ingredients were placed in the 1S attritor:

| Ingredient | Amount (g) |
|---|---|
| Copolymer of ethylene and methacrylic acid of Ex. 1 | 132.8 |
| Yellow 17 flush, Sun Chemical Co., | 120.0 |
| Aluminum stearate, Witco Chemical Corp., New York, NY | 3.0 |
| Isopar ®-L, nonpolar liquid having a Kauri-butanol value of 27, Exxon Corporation | 1200 |

The ingredients were cold ground for 3 hours instead of 6 hours. The developer was diluted to 3% solids and charged with 70 mg/g Basic Barium Petronate ®. The resultant charged toner was divided into 2 portions and to one portion was added Zirconium 2-ethylhexoate. The toner was allowed to equilibrate for 3 days and mobility and conductivity of the two developers was determined as described above. Results are shown in Table 7.

TABLE 7

| ADDITIVE | MOBILITY | CONDUCTIVITY |
|---|---|---|
| None (Control) | −10.2 | 49 |
| 0.5% Zr 2-ethylhexoate | −14.1 | 40 |

The organometallic compounds when used in combination with Basic Barium Petronate ® result in developers having improved mobility.

The following procedure was used to measure the mottle image degfect in the following controls and examples:

A 4 by 12 inch (10.16 by 30.48 cm) sheet of Textweb paper (Champion Paper, Inc., Stamford, CN) is placed on a laboratory automatic drawdown machine (P. N. Gardner Co., Inc., Pompano Beach, FL). Five drops of 10% solids liquid developer are placed on the paper which had been previously wetted with Isopar ®-L. The developer puddle is spread with a Gardco wet film applicator rod (12 gauge). The developer layer is dried by placing the paper in an air circulating oven at 135°-139° C. (VWR, Model 1430). The developed layer is examined for mottle visually.

The viscosity of the liquid developers was measured on the Haake RV3 at 23° C., shear rate 0 to 150 minute$^{-1}$, using the coaxial NVSt tool. Haake Buchler Instruments, Inc., Saddle Brook, NJ, makes the instrument.

CONTROL 2

A cyan developer was prepared by adding 308.0 g of a copolymer of ethylene (90%) and methacrylic acid (10%), melt index at 190° C. is 500, acid no. is 60, 35.0 g of Heliogen ® Blue NBD 7010 pigment (BASF Corporation, Parsippany, NJ), 7.0 g of aluminum distearate (Witco Chemical Corporation, Houston, TX), and 946.0 g of Isopar ®-L (Exxon Corporation) to a Union Process 1S Attritor (Union Process Company, Akron, OH) charged with 0.1875 inch (4.76 mm) diameter carbon steel balls. The mixture was milled at 80° C. for 1 hour then 454.0 g of Isopar ®-L were added. The mixture was cooled and milled for 1 hour at ambient temperature. Again 583.0 g of Isopar ®-L were added and the mixture was milled for 3 more hours. The particle size was <8.7 μm.

EXAMPLE 8

The developer concentrate from Control 2 was diluted and charged as follows: 100 g of 3.0% solids were charged with a charge director or an organometallic compound and a charge director as outlined in Table 8 below. The mottle image defect test as described above was run with the results outlined in Table 8 below. The viscosity of these samples were determined as described above; results are outlined in Table 8. The mobilities were determined as described in Example 1. The following charge directors were used in this test; Basic Barium Petronate ® (BBP) (Witco Chemical Corporation, New York City, NY), Basic Calcium Petronate ® (BCP) (Witco Chemical Corporation, New York City, NY), and Emphos ® D70-30C (E) (Witco Chemical Corporation, Houston, TX). Magnesium octoate (Hüls America, Inc., Piscataway, NJ) was used as the organometallic compound.

TABLE 8

| Charge Director (mg/g) | Organometallic Compound (% solids) | Mottle Rating | Conductivity (pmho/cm) | Mobility ($m^2/Vsec x 10^{-10}$) | Viscosity (cp) |
|---|---|---|---|---|---|
| BBP;70 | 0 | 3.0 | 26.4 | −13.4 | 2.14 |
| BBP;70 | 1 | 1.5 | 22.2 | −12.3 | 2.09 |
| BCP;70 | 0 | 3.0 | 10.8 | −10.0 | 2.11 |
| BCP;70 | 1 | 1.5 | 4.2 | −2.7 | 2.11 |
| E;50 | 0 | 3.0 | 16.2 | −4.2 | 2.19 |

TABLE 8-continued

| Charge Director (mg/g) | Organometallic Compound (% solids) | Mottle Rating | Conductivity (pmho/cm) | Mobility ($m^2/Vsecx10^{-10}$) | Viscosity (cp) |
|---|---|---|---|---|---|
| E;50 | 1 | 1.5 | 21.5 | −8.4 | 2.08 |

EXAMPLE 9

The developer concentrate from Control 2 was diluted and charged as follows: 100 g of 10.0% solids were charged with Basic Barium Petronate® (Witco Chemical Corporation, New York City, NY) at 20 mg/g and various organometallic compounds were added at 1% solids as set out in Table 9 below. The mottle image defect test as described above was run with the results outlined in Table 9 below. The organometallic compounds used were mixtures of 15.8% bismuth 2-ethylhexoate and 1.8% calcium 2-ethylhexoate in mineral spirits (1); and 7.8% bismuth 2-ethylhexoate and 8.5% cerium 2-ethylhexoate in mineral spirits (2).

TABLE 9

| Organometallic Compound | Mottle Rating |
|---|---|
| none | 3 |
| (1) | 1 |
| (2) | 1 |

CONTROL 3

A black liquid developer was prepared by adding 308.0 g of a copolymer of ethylene (90%) and methacrylic acid (10%), melt index at 190° C. is 500, acid no. is 60, 35.0 g of Sterling® NS Black pigment (Cabot Corporation, Boston, MA), 7.0 g of aluminum distearate (Witco Chemical Corporation, Houston, TX). and 946.0 g of Isopar®-L (Exxon Corporation) to a Union Process 1S Attritor (Union Process Company, Akron, OH) charged with 0.1875 inch (4.76 mm) diameter carbon steel balls. The mixture was milled at 80° C. for 1 hour than 454.0 g of Isopar®-L were added. The mixture was cooled and milled for 1 hour at ambient temperature. Again 583.0 g of Isopar®-L were added and the mixture was milled for 3 more hours. The particle size was <8.7 μm.

EXAMPLE 10

The developer concentrate from Control 3 was diluted and charged as follows: 100 g of 3.0% solids were charged with a charge director or a manganese octoate organometallic compound (Hüls America, Inc., Piscataway, NJ), and a charge director as outlined in Table 10 below. The mottle image defect test as described above was run with the results outlined in Table 10 below. The viscosity of these samples were determined as described above; results are outlined in Table 10. The mobilities were determined as described in Example 1.

TABLE 10

| Charge Director (mg/g) | Organometallic Compound (% solids) | Mottle Rating | Conductivity (pmho/cm) | Mobility ($m^2/Vsecx10^{-10}$) | Viscosity (cp) |
|---|---|---|---|---|---|
| BBP;70 | 0 | 3.0 | 50.3 | −17.3 | 2.23 |
| BBP;70 | 1 | 1.5 | 40.0 | −16.6 | 2.23 |
| BCP;70 | 0 | 3.0 | 9.8 | −9.7 | 2.25 |
| BCP;70 | 1 | 1.5 | 5.2 | −4.4 | 2.21 |
| E;50 | 0 | 3.0 | 14.9 | −9.6 | 2.35 |
| E;50 | 1 | 1.5 | 24.7 | −12.0 | 2.33 |

We claim:

1. An electrostatic liquid developer consisting essentially of (A) a nonpolar liquid having a Kauri butanol value of less than 30, present in 85 to 99.9% by weight, based on the total weight of liquid developer, (B) particles having an average by area particle size of less than 30 μm of a thermoplastic resin having free carboxyl groups, (C) a nonpolar liquid soluble charge director compound selected from the group consisting of oil-soluble petroleum sulfonate and anionic glycerides present in an amount of 0.25 to 1500 mg/g developer solids, and (D) at least one organometallic compound selected from the group consisting of $M^{+n}(R^-)_n$, $M^{+n}(CO_2R'^-)_n$ and $M^{+n}(OR''^-)_n$ where R, R', and R'', which can be the same or different, are moieties of a linear hydrocarbon of 1 to 30 carbon atoms, a branched chain hydrocarbon of 1 to 30 carbon atoms, or a linear or branched chain, substituted hydrocarbon of 1 to 30 carbon atoms, M is a metal, and n is at least 2 and is equal to the valency of the metal present in 0.01 to 0.15 part by weight metal based on the total weight of liquid developer, the total weight of developer solids being 0.1 to 15% by weight.

2. An electrostatic liquid developer according to claim 1 wherein the substituents attached to $M^{+n}$ in the formula for the organometallic compound is selected from the group consisting of propionate, butyrate, hexoate, octoate, nonoate, 2-ethylhexoate, neodecanoate, naphthenate, ethoxide, butyl, and isopropyl, and M is selected from the group consisting of Bi, Ca, Ce, Co, Fe, Mg, Mn, Mo, Ni, Pb, Ti, V, Zn and Zr.

3. An electrostatic liquid developer according to claim 2 wherein the organometallic compound is selected from the group consisting of zinc naphthenate, zinc 2-ethylhexoate, zinc octoate, zirconium octoate, zirconium 2-ethylhexoate, manganese octoate, manganese naphthenate, manganese 2-ethylhexoate, barium 2-ethylhexoate, cobalt naphthenate, calcium octoate, calcium naphthenate, calcium 2-ethylhexoate, calcium nonoate, nickel octoate, bismuth octoate, bismuth neodecanoate, bismuth 2-ethylhexoate, lead octoate, cobalt octoate, lead naphthenate, cerium naphthenate, cerium 2-ethylhexoate, tetrabutyl titanate, tetra-2-ethylhexyl titanate, titanium tetraethoxide, tetraisopropyl titanate, calcium, cerium, cobalt, lead, manganese, zinc and zirconium neodecanoate, and mixtures thereof.

4. An electrostatic liquid developer according to claim 1 containing up to about 60% by weight of a colorant based on the total weight of developer solids.

5. An electrostatic liquid developer according to claim 4 wherein the colorant is a pigment.

6. An electrostatic liquid developer according to claim 4 wherein the colorant is a dye.

7. An electrostatic liquid developer according to claim 1 wherein a fine particle size inorganic oxide is present.

8. An electrostatic liquid developer according to claim 1 wherein an additional compound is present which is an adjuvant selected from the group consisting of polyhydroxy compound, aminoalcohol, polybutylene succinimide, metallic soap, and aromatic hydrocarbon.

9. An electrostatic liquid developer according to claim 4 wherein an additional compound is present which is an adjuvant selected from the group consisting of polyhydroxy compound, aminoalcohol, polybutylene succinimide, metallic soap, and aromatic hydrocarbon.

10. An electrostatic liquid developer according to claim 8 wherein a polyhydroxy adjuvant compound is present.

11. An electrostatic liquid developer according to claim 8 wherein an aminoalcohol adjuvant compound is present.

12. An electrostatic liquid developer according to claim 11 wherein the aminoalcohol adjuvant compound is triisopropanolamine.

13. An electrostatic liquid developer according to claim 8 wherein a polybutylene succinimide adjuvant compound is present.

14. An electrostatic liquid developer according to claim 8 wherein a metallic soap adjuvant compound is present.

15. An electrostatic liquid developer according to claim 8 wherein an aromatic hydrocarbon adjuvant compound is present.

16. An electrostatic liquid developer according to claim 1 wherein the thermoplastic resin is a copolymer of ethylene and an unsaturated acid selected from the group consisting of acrylic acid and methacrylic acid.

17. An electrostatic liquid developer according to claim 1 wherein the thermoplastic resin is a copolymer of ethylene (80 to 99.9%)/acrylic or methacrylic acid (20 to 0.1%)/alkyl ester of acrylic or methacrylic acid wherein alkyl is 1 to 5 carbon atoms (0 to 20%).

18. An electrostatic liquid developer according to claim 4 wherein the thermoplastic resin is a copolymer of ethylene (80 to 99.9%)/acrylic or methacrylic acid (20 to 0.1%)/alkyl ester of acrylic or methacrylic acid wherein alkyl is 1 to 5 carbon atoms (0 to 20%).

19. An electrostatic liquid developer according to claim 17 wherein the thermoplastic resin is a copolymer of ethylene (90%)/methacrylic acid (10%) having a melt index at 190° C. of 500.

20. An electrostatic liquid developer according to claim 1 wherein the particles have an average particle size of less than 10 μm.

21. An electrostatic liquid developer according to claim 1 wherein component (C) is an oil-soluble petroleum sulfonate.

22. An electrostatic liquid developer according to claim 1 wherein component (C) is an anionic glyceride.

23. A process for preparing electrostatic liquid developer for electrostatic imaging comprising (A) dispersing at an elevated temperature in a vessel a thermoplastic resin having free carboxyl groups, a dispersant nonpolar liquid having a Kauri-butanol value of less than 30, and, optionally a colorant, while maintaining the temperature in the vessel at a temperature sufficient to plasticize and liquify the resin and below that at which the dispersant nonpolar liquid degrades and the resin and/or colorant decomposes, (B) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(C) separating the dispersion of toner particles having an average particle size of less than 30 μm from the particulate media, (D) adding to the dispersion a nonpolar liquid soluble ionic or zwitterionic charge director compound selected from the group consisting of oil-soluble petroleum sulfonate and anionic glycerides, and (E) adding subsequent to step (C) at least one organometallic compound, selected from the group consisting of formula:

$$M^{+n}(R^-)_n,$$

$$M^{+n}(CO_2R'^-)_n$$

and $$M^{+n}(OR''^-)_n$$

where R, R' and R'', which can be the same or different, are moieties of a linear hydrocarbon of 1 to 30 carbon atoms, a branched chain hydrocarbon of 1 to 30 carbon atoms, or a linear or branched chain, substituted hydrocarbon of 1 to 30 carbon atoms, M is a metal, and n is at least 2 and is equal to the valency of the metal wherein the nonpolar liquid is present in 85 to 99.9% by weight, based on the total weight of liquid developer, the total weight of developer solids is 0.1 to 15.0% by weight, and the ionic or zwitterionic charge director compound is present in an amount of 0.25 to 1500 mg/g developer solids, and the at least one organometallic compound is present in 0.01 to 0.15 part by weight metal based on the total weight of liquid developer.

24. A process according to to claim 23 wherein the substituents attached to $M^{+n}$ in the formula for the organometallic compound is selected from the group consisting of propionate, butyrate, hexoate, octoate, nonoate, 2-ethylhexoate, neodecanoate, naphthenate, ethoxide, butyl, and isopropyl, and M is selected from the group consisting of Bi, Ca, Ce, Co, Fe, Mg, Mn, Mo, Ni, Pb, Ti, V, Zn and Zr.

25. A process according to claim 24 wherein the organometallic compound is selected from the group consisting of zinc naphthenate, zinc 2-ethylhexoate, zinc octoate, zirconium octoate, zirconium 2-ethylhexoate, manganese octoate, manganese naphthenate, manganese 2-ethylhexoate, barium 2-ethylhexoate, cobalt naphthenate, calcium octoate, calcium naphthenate, calcium 2-ethylhexoate, calcium nonoate, nickel octoate, bismuth octoate, bismuth neodecanoate, bismuth 2-ethylhexoate, lead octoate, cobalt octoate, lead naphthenate, cerium naphthenate, cerium 2-ethylhexoate, tetrabutyl titanate, tetra-2-ethylhexyl titanate, titanium tetraethoxide, tetraisopropyl titanate, calcium, cerium, cobalt, lead, manganese, zinc and zirconium neodecanoate, and mixtures thereof.

26. A process according to claim 23 wherein there is present in the vessel up to 100% by weight of a polar additive having a Kauri-butanol value of at least 30, the percentage based on the total weight of the liquid.

27. A process according to claim 23 wherein the particulate media are selected from the group consisting of stainless steel, carbon steel, ceramic, alumina, zirconia, silica and sillimanite.

28. A process according to claim 23 wherein the thermoplastic resin is a copolymer of ethylene and an unsaturated acid selected from the group consisting of acrylic acid and methacrylic acid.

29. A process according to claim 23 wherein the thermoplastic resin is a copolymer of ethylene (80 to 99.9%)/acrylic or methacrylic acid (20 to 0.1%)/alkyl ester of acrylic or methacrylic acid wherein alkyl is 1 to 5 carbon atoms (0 to 20%).

30. A process according to claim 29 wherein the thermoplastic resin is a copolymer of ethylene (90%) methacrylic acid (10%) having a melt index at 190° C. of 500.

31. A process according to claim 23 wherein the charge director compound is an oil-soluble petroleum sulfonate.

32. A process according to claim 23 wherein the charge director is an anionic glyceride.

33. A process according to claim 23 wherein the additional nonpolar liquid, polar liquid, or combinations thereof is present to reduce the concentration of toner particles to between 0.1 to 15 percent by weight with respect to the liquid.

34. A process according to claim 33 wherein the concentration of toner particles is reduced by additional nonpolar liquid.

35. A process according to claim 23 wherein cooling the dispersion is accomplished while grinding by means of particulate media to prevent the formation of a gel or solid mass with or without the presence of additional liquid.

36. A process according to claim 23 wherein cooling the dispersion is accomplished without stirring to form a gel or solid mass, followed by shredding the gel or solid mass and grinding by means of particulate media with or without the presence of additional liquid.

37. A process according to claim 23 wherein cooling the dispersion is accomplished with stirring to form a viscous mixture and grinding by means of particulate media with or without the presence of additional liquid.

38. A process according to claim 23 wherein an adjuvant compound selected from the group consisting of polyhydroxy compound, aminoalcohol, polybutylene succinimide, metallic soap, and aromatic hydrocarbon is added during the dispersing step (A).

39. A process according to claim 38 wherein the adjuvant compound is an aminoalcohol.

40. A process according to claim 39 wherein the aminoalcohol is triisopropanolamine.

41. A process according to claim 33 wherein an adjuvant compound selected from the group consisting of polyhydroxy compound, aminoalcohol, polybutylene succinimide, metallic soap, and an aromatic hydrocarbon is added to the liquid developer.

42. A process according to claim 41 wherein the adjuvant compound is a polyhydroxy compound.

43. A process according to claim 42 wherein the polyhydroxy compound is ethylene glycol.

44. A process according to claim 41 wherein the adjuvant compound is a metallic soap dispersed in the thermoplastic resin.

45. A process according to claim 44 wherein the adjuvant compound is an aluminium stearate.

46. A process for preparing electrostatic liquid developer comprising (A) dispersing a colorant in a thermoplastic resin in the absence of a dispersant nonpolar liquid having a Kauri-butanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average particle size of less than 30 μm from the particulate media, and (E) adding additional nonpolar liquid, polar liquid or combinations thereof to reduce the concentration of toner particles to between 0.1 to 15.0 percent by weight with respect to the liquid, (F) adding to the dispersion a liquid soluble ionic or zwitterionic charge director compound selected from the group consisting of oil-soluble petroleum sulfonate and anionic glycerides, and (G) adding subsequent to step (D) at least one organometallic compound selected from the group consisting of formula:

$$M^{+n}(R^-)_n,$$

$$M^{+n}(CO_2R'^-)_n$$

and $$M^{+n}(OR''^-)_n$$

where R, R′ and R″, which can be the same or different, are moieties of a linear hydrocarbon of 1 to 30 carbon atoms, a branched chain hydrocarbon of 1 to 30 carbon atoms, or a linear or branched chain, substituted hydrocarbon of 1 to 30 carbon atoms, M is a metal, and n is at least 2 and is equal to the valency of the metal wherein the nonpolar liquid is present in 85 to 99.9% by weight, based on the total weight of liquid developer, the total weight of developer solids is 0.1 to 15.0% by weight, and the ionic or zwitterionic charge director compound is present in an amount of 0.25 to 1500 mg/g developer solids, and the at least one organometallic compound is present in 0.01 to 0.15 part by weight metal based on the total weight of liquid developer.

47. A process for preparing electrostatic liquid developer comprising (A) dispersing a colorant in a thermoplastic resin in the absence of a dispersant nonpolar liquid having a Kauri-butanol value of less than 30 to form a solid mass (B) shredding the solid mass, (C) redispersing the shredded solid mass at an elevated temperature in a vessel in the presence of a dispersant nonpolar liquid having a Kauri-butanol value of less than 30, and optionally a colorant, while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average particle size of less than 30 μm from the particulate media, and (F) adding additional nonpolar liquid, polar liquid or combinations thereof to reduce the concentration of toner particles to between 0.1 to 15.0 percent by weight with respect to the liquid, (G) adding to the dispersion a liquid soluble ionic or zwitterionic charge director compound, and (H) adding subsequent to step (E) at least one organometallic compound selected from the group consisting of formula:

$$M^{+n}(R^-)_n,$$

$$M^{+n}(CO_2R'^-)_n$$

and $$M^{+n}(OR''^-)_n$$

where R, R′ and R″, which can be the same or different, are moieties of a linear hydrocarbon of 1 to 30 carbon atoms, a branched chain hydrocarbon of 1 to 30 carbon atoms, or a linear or branched chain, substituted hydrocarbon of 1 to 30 carbon atoms, M is a metal, and n is at least 2 and is equal to the valency of the metal wherein the nonpolar liquid is present in 85 to 99.9% by weight, based on the total weight of liquid developer, the total weight of developer solids is 0.1 to 15.0% by weight, and the ionic or zwitterionic charge director compound is present in an amount of 0.25 to 1500 mg/g developer solids, and the at least one organometallic compound is present in 0.01 to 0.15 part by weight metal based on the total weight of liquid developer.

* * * * *